United States Patent [19]

Nonaka et al.

[11] Patent Number: 4,461,260

[45] Date of Patent: Jul. 24, 1984

[54] FUEL INJECTION SYSTEM FOR TWO-CYCLE INTERNAL COMBUSTION ENGINES

[75] Inventors: Kimihiro Nonaka, Hamamatsu; Yukio Matsushita, Iwata, both of Japan

[73] Assignee: Sanshin Kogyo Kabushiki Kaisha, Hamamatsu, Japan

[21] Appl. No.: 503,659

[22] Filed: Jun. 13, 1983

Related U.S. Application Data

[63] Continuation-in-part of Ser. No. 446,726, Dec. 3, 1982.

[30] Foreign Application Priority Data

Jul. 1, 1982 [JP] Japan ..... 57-112579

[51] Int. Cl.[3] ..... F02M 51/00; F02B 33/04

[52] U.S. Cl. ..... 123/478; 123/73 R; 123/73 A; 123/382; 123/378; 123/65 R

[58] Field of Search ..... 123/378, 382, 478, 73 R, 123/73 A, 74 R, 74 A, 488, 73 B, 73 C, 65 R

[56] References Cited

U.S. PATENT DOCUMENTS

| | | | |
|---|---|---|---|
| 2,952,252 | 9/1960 | Geatty | 123/73 A |
| 3,425,403 | 2/1969 | May | 123/73 A |
| 3,698,368 | 10/1972 | Yamamoto | 123/73 A |
| 3,734,072 | 5/1973 | Yamda | 123/73 A |
| 4,096,831 | 6/1978 | Gunda | 123/488 |
| 4,413,508 | 11/1983 | Kawamura et al. | 123/478 |

FOREIGN PATENT DOCUMENTS

| | | | |
|---|---|---|---|
| 747534 | 4/1956 | United Kingdom | 123/73 A |

*Primary Examiner*—Wendell E. Burns
*Attorney, Agent, or Firm*—Ernest A. Beutler

[57] ABSTRACT

Several embodiments of fuel injection controls for two-cycle crankcase compression internal combustion engines. In each embodiment, the fuel injection is controlled by measuring the amount of air inducted through measurement of the pressure generated in the crankcase. In each embodiment, abnormal pressure variations in the crankcase not due to the amount of air inducted are eliminated by measuring the pressures at predetermined crankshaft angles. In some embodiments, this is done through the use of a valving arrangement and in other embodiments, this is done electronically.

26 Claims, 6 Drawing Figures

FUEL INJECTION SYSTEM FOR TWO-CYCLE INTERNAL COMBUSTION ENGINES

CROSS REFERENCE TO RELATED APPLICATION

This application is a continuation-in-part of our application entitled "Fuel Injection Apparatus For An Internal Combustion Engine," Ser. No. 446,726, filed Dec. 3, 1982 and assigned to the Assignee of this application.

BACKGROUND OF THE INVENTION

This invention relates to a fuel injection apparatus for an internal combustion engine and more particularly to an improved control arrangement for a fuel injection system.

In fuel injected engines, it is, of course, extremely important to accurately control the quantity of fuel injected in accordance with the air inducted in order to achieve the optimum fuel/air ratio for a given operating condition of the engine. Various devices have been proposed for measuring the air flow in an induction system of an engine to control the amount of fuel injected. Coventionally, such air flow measuring devices have been large and complicated and have been positioned in the induction system, normally upstream of the point of discharge of the fuel. In one type of flow detector, a flap type arrangement is provided in the intake passage and has a member that swings open to an amount that is determined by the air flow. The angular position of this detector is then measured and used to provide an air flow signal for the fuel injection system. Alternatively, vortex type air flow meters have been positioned in the induction system for determining air flow. Still another type of measuring device employs a hot wire anemometer which provides an electrical resistance wire interposed in the air stream to have its resistance vary in relation to the speed, i.e., cooling effect, of the air flowing through the induction system. The use of such flow meters in the induction system has several disadvantages.

In the first instance, the provision of an air flow measuring device in the induction system can oftentimes reduce the volumetric efficiency of the induction system. Furthermore, such devices substantially increase the size of the induction system. Also, devices of the type aforenoted are not particularly efficient with engines having a low number of cylinders or specifically with single cylinder engines due to the pulsations in the intake flow. Although such pulsations may be reduced to some extent through the use of a plenum chamber, this adds still further to the size of the induction system. Furthermore, if the flow meter is used in conjunction with the internal combustion engine of an outboard motor or other marine application, there is a high likelihood of corrosion in the moving components of the flow meter due to the salt in the atmosphere.

In our aforenoted co-pending application, there is disclosed a control for a fuel injection system that has none of the foregoing disadvantages. The system disclosed in that patent application senses the pressure in the crankcase of a two-cycle engine and uses the sensed pressure to control the amount of fuel injected. It has been found that the pressure in the crankcase is, if accurately measured, indicative of the amount of air inducted.

Although the arrangement shown in our earlier patent application is particularly effective in controlling the amount of fuel injected without the disadvantages of the prior art type air flow measuring devices, there are some instances when the crankcase pressure is not actually related to the amount of air inducted. For example, with two-cycle crankcase compression engines it has been found that the peak pressure immediately prior to the piston reaching bottom dead center is abnormally raised when the transfer or scavenge port is open due to the back flow of exhaust gases into the crankcase. As noted in our earlier patent application, one desirable method for controlling the amount of fuel injected involves sensing both the minimum and maximum pressures in the chamber. However, since the maximum pressure is abnormally high due to the opening of the scavenge port and the back flow of exhaust gases such a control arrangement is not as accurate as might be.

It is, therefore, a principal object of this invention to provide an improved fuel flow control device for the fuel injection system of an internal combustion engine.

It is another object of this invention to provide an improved air flow detecting device for controlling the fuel injection system of an engine.

It is yet another object of this invention to provide a fuel control device for a fuel injection system of an internal combustion engine that accurately controls fuel flow in response to the amount of air flowing through the intake system.

It is a yet further object of this invention to provide a fuel control for a fuel injection system that does not rely upon a device that is interposed in the air induction system.

It is yet another object of this invention to provide a fuel injection control system that senses differences in crankcase pressure and which eliminates the effects of abnormal changes in crankcase pressure due to effects other than the amount of air inducted.

SUMMARY OF THE INVENTION

A first feature of the invention is adapted to be embodied in a fuel injection control system for an internal combustion engine comprising a chamber that varies in volume during a cycle of operation and in which an intake charge is compressed during engine operation and fuel injection means for delivering fuel to an air charge. In accordance with this feature of the invention, means control the fuel delivered by the fuel injection means in response to the pressure in the chamber for only a predetermined portion of the engine cycle.

Another feature of this invention is also adapted to be embodied in a fuel injection control system for an internal combustion engine. Such an engine has a variable volume chamber, an induction system for delivering a charge to the chamber and a fuel injection means for delivering fuel. In accordance with this feature of the invention, means control the fuel delivered by the fuel injection means in response to a pressure that varies during a single cycle of engine operation for only a predetermined portion of the engine cycle.

Another feature of the invention is adapted to be embodied in a method for controlling the fuel discharge of a fuel injection system for an internal combustion engine having a chamber that varies in volume during a cycle of engine operation and in which the intake charge is compressed during engine operation. In accordance with this method, the pressure in the chamber is measured for only a predetermined portion of the engine cycle and the amount of fuel discharged by the fuel injection system is controlled in response to this pressure.

Yet another feature of the invention is also adapted to be embodied in a method for controlling the fuel discharge of a fuel injection system in connection with an engine that has a chamber that varies in volume during a cycle of engine operation, an induction system for delivering a charge to the chamber and fuel injection means for delivering fuel. In accordance with this method, the variable pressure in the chamber during only a predetermined portion of a single cycle of engine operation is measured and the amount of fuel delivered by the injection system is controlled in response to this pressure.

DETAILED DESCRIPTION OF THE PREFERRED EMBODIMENTS

Figure 1:
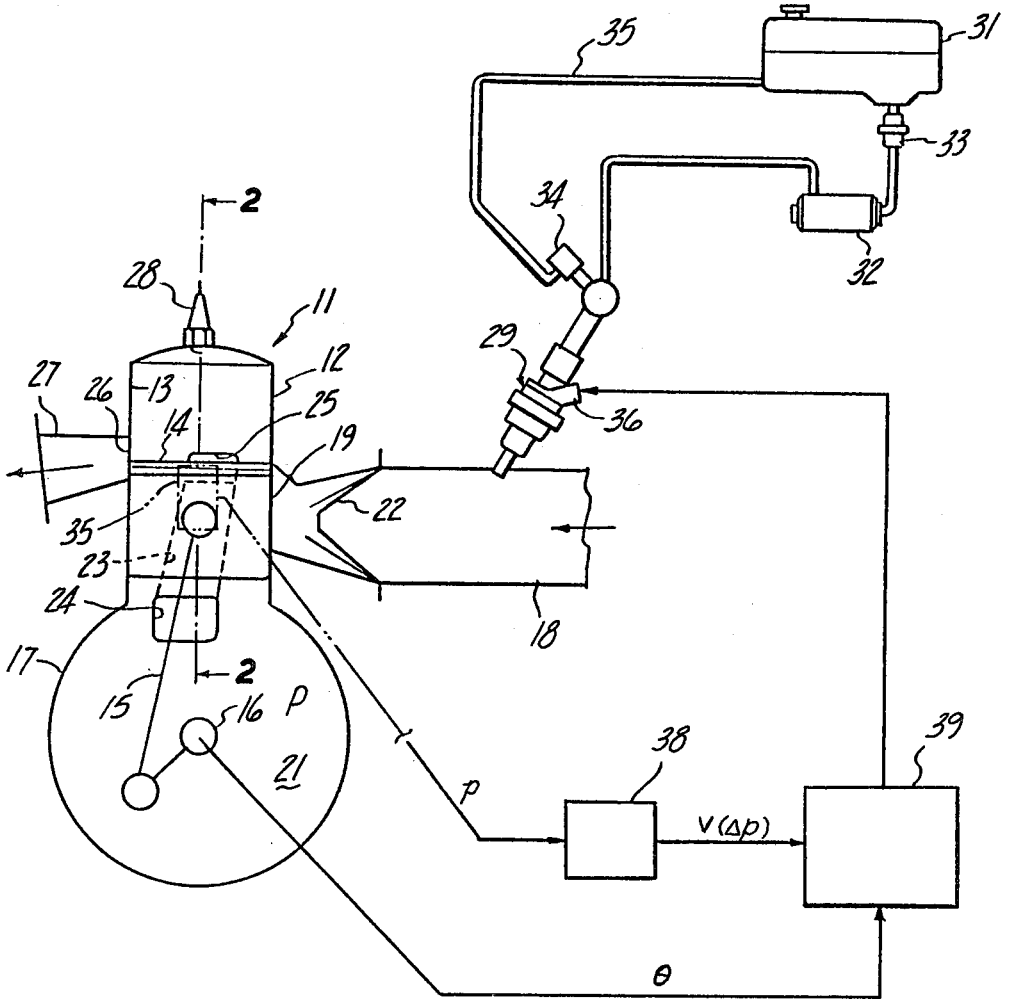
FIG. 1 is a partially schematic view of an internal combustion engine constructed in accordance with a first embodiment of the invention and operating according to an embodiment of the invention.
Figure 2:
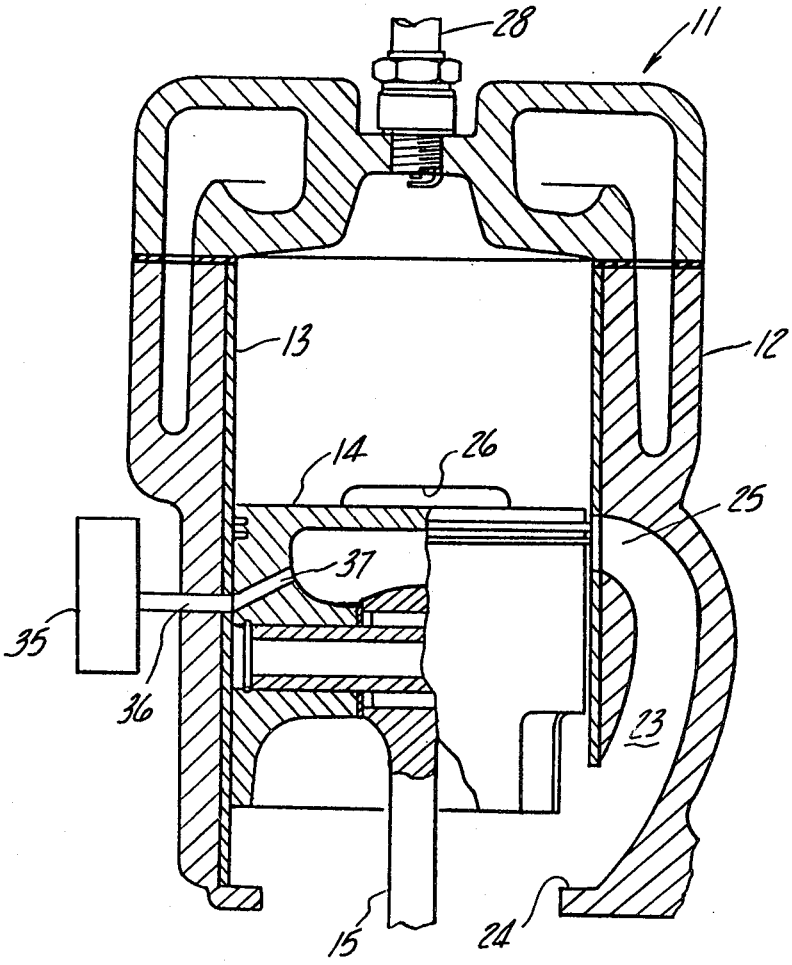
FIG. 2 is an enlarged cross-sectional view taken along the line 2—2 of FIG. 1.
Figure 3:
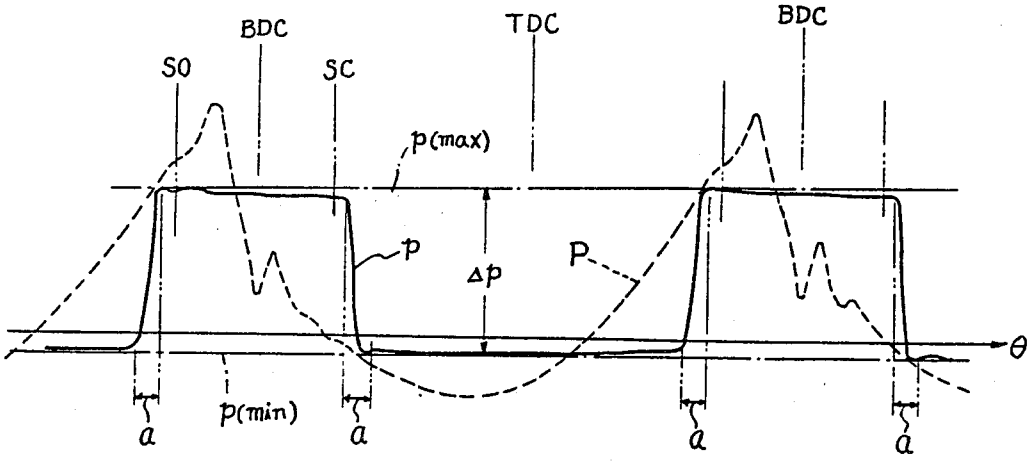
FIG. 3 is a pressure crankshaft angle curve explaining the operation of the embodiment of FIGS. 1 and 2.

Referring now specifically to the embodiment of FIGS. 1 through 3, a single cylinder two cycle, crankcase compression, internal combustion engine constructed in accordance with an embodiment of the invention is shown in part in cross-section and in part schematically and is identified generally by the reference numeral 11. The engine 11 includes a cylinder block 12 having a cylinder bore 13 in which a piston 14 is supported for reciprocation in a known manner. The piston 14 is connected by means of a connecting rod 15 to a crankshaft 16 that is rotatably journalled in a known manner in a crankcase 17 of the engine.

The engine 11 includes an intake system that comprises an air intake pipe 18 that terminates in an intake port 19 that sequentially communicates with sealed volume 21 within the crankcase 17 when the piston 14 is above a certain predetermined position above its bottom dead center position. A reed type check valve 22 is positioned in the induction passage 18 so as to prevent undesirable reverse flow from the crankcase cavity 21 back into the induction system 18.

A transfer or scavenge passage 23 extends through the cylinder block 12 and terminates at an inlet opening 24 in the crankcase cavity 21. The upper end of the scavenge or transfer passage 23 terminates in an inlet scavenge port 25 formed in the cylinder wall 13 at a point above the bottom dead center position of the piston 14.

An exhaust port 26 is also formed in the cylinder bore 13 and communicates with an exhaust passage 27 for the discharge of exhaust gases to the atmosphere. The exhaust port 26 is positioned above the bottom dead center position of the piston 14 and is slightly higher in the cylinder bore 13 than the transfer or scavenge port 25.

A spark plug is provided in the cylinder head of the engine for firing a charge.

The engine 11 is provided with a fuel injection system that includes an injection nozzle 29 that discharges into the intake pipe 18 upstream of the reed type check valve 22. Fuel is supplied to the nozzle 29 from a fuel tank 31 by means of an appropriate fuel pump 32. A fuel filter or strainer 33 is interposed in the conduit connecting the fuel tank 31 with the pump 32. A pressure control valve 34 is provided in the supply line to the fuel injection nozzle 29 and has a return line 35 that extends back to the fuel tank 31. The valve 34 insures that a substantially constant pressure of fuel is delivered to the injection nozzle 29.

The injection nozzle 29 includes an electro-magnetic controller 36 that functions in a known manner so as to control the amount of fuel discharged by the nozzle 29 into the intake pipe 18.

During running of the engine, an intake air charge is delivered to the intake pipe 18 and fuel is injected by the nozzle 29 to provide a fuel/air mixture which is admitted to the crankcase chamber 21 when the piston 14 has moved upwardly so as to uncover the intake port 19. The reed valve 22 will be opened under this condition so long as the pressure upstream of it exceeds the pressure on its downstream side. At the same time, the piston 14 is moving upwardly to induct an air/fuel charge into the crankcase chamber 21, the spent combustion products will be discharged through the exhaust port 26 and exhaust passage 27. Furthermore, the charge which has been previously transferred from the crankcase chamber 21 to the upper side of the piston 14 through the transfer or scavenge passage 23, which charge has been compressed, will be delivered to the spark plug 24 for firing as is typical with engines operating on the two stroke principle.

As has been noted in our earlier co-pending application, accurate control of the amount of fuel injected by the nozzle 29 is extremely important. In that application, several embodiments are disclosed that provide fuel control in response to pressure in the crankcase chamber 21, which has been found to be an accurate indicator of the amount of air inducted. By controlling the amount of fuel injected by the nozzle 29 in response to pressure (P) in the crankcase chamber 21, it is possible to provide good fuel control without the disadvantages of air flow measurement devices positioned in the intake pipe 18, as have been previously employed.

One embodiment of our co-pending application provides fuel control by sensing the maximum and minimum pressures existent in the crankcase chamber 21 and using the difference as a control signal indicative of the amount of air inducted. Such an arrangement has particular utility since this pressure difference if correctly measured is a very accurate measurement of air flow. However, it has been found that there are pressure variations occuring in the crankcase chamber 21 that result from engine operation and which are not necessarily related to the amount of air inducted.

This phenomena can best be understood by reference to FIG. 3. FIG. 3 is a chart or map showing a crankcase angle ($\theta$) on the abscissa and crankcase pressure (P) on the ordinate. The broken line P indicates the actual pressure in the chamber 21 at various crank angles during a normal running condition. The bottom dead center position of the piston 14 is identified by the line BDC and the top dead center is indicated by the line TDC.

It should be noted that as the crankshaft 16 undergoes its rotation and the piston 14 moves downwardly from the top dead center position to its bottom dead center position, there is a rise in pressure P in the chamber 21. This rise in pressure follows a generally smooth curve until the point when the piston 14 moves downwardly sufficient to open the scavenge port 25. When the scavenge port 25 is opened (SO), the pressure existing in the cylinder bore 13 above the piston 14, which has been generated by the previous firing of the charge in this chamber, will cause a portion of the high pressure exhaust gases to back flow into the crankcase chamber 21 through the scavenge passage 23. Hence, there will be a pressure rise that causes a discontinuity in the pressure curve as is clearly shown in FIG. 3. This pressure increase will reach a peak normally before the piston 14 reaches its bottom dead center position. As the piston 14 continues to move downwardly, the fresh fuel/air charge in the crankcase chamber 21 will eventually be transferred through the scavenge port 23 to the area in the cylinder bore 13 above the piston, as is well known. This will cause a decrease in pressure in the chamber 21 even while the piston 14 is still travelling toward its bottom dead center position. As the piston 14 passes its bottom dead center position, the volume of the chamber 21 will increase and there will be a further decrease in pressure in the chamber 21 which causes a fresh fuel/air charge to be drawn through the intake port 19.

In accordance with this invention, several arrangements or embodiments are disclosed for measuring the peak pressure in the crankcase chamber 21 at a predetermined crank angle and before the transfer port opening 25 is uncovered by the piston 14 so as to eliminate the effects of false pressure readings causes by back flow of exhaust gases into the chamber 21. A first embodiment of arrangement for achieving this effect is illustrated in FIGS. 1 through 3.

A pressure sensor 35 is provided that is adapted to give an output signal indicative of pressure. The pressure sensor 35 communicates with the crankcase chamber 21 in a timed relationship by means including a port 36 that extends through the cylinder block 12 and terminates in an inlet opening in the cylinder bore 13. This opening is disposed so that it will be at times covered by the side or skirt of the piston 14.

The piston 14 is, in turn, provided with a sensing port 37 that extends through its skirt from beneath the ring area and which terminates in the hollow interior of the piston 14. Hence, when the piston 14 is in the position as shown in FIG. 2, the ports 36 and 37 will communicate with each other and pressure in the crankcase chamber 21 will be exerted on the pressure sensing device 35. When the sensing passages 36 and 37 are not aligned, the crankcase pressure previously sensed will be trapped in the sensing device 35.

The passages 36 and 37 are so oriented so as to communicate with each other immediately prior to the time when the piston 14 uncovers the scavenge port 25 on its downward movement and immediately subsequent to the time when the port 25 is closed after movement of the piston 14 toward its upward position from bottom dead center. As a result, the sensing device 35 will sense maximum pressure in the crankcase chamber 21 immediately prior to opening of the scavenge passage 23 and minimum pressure immediately subsequent to closing of the scavenge passage 23.

Referring again to FIG. 3, the solid line curve shows the pressure signal transmitted by the pressure sensing device 35 during engine operation. When the piston 14 is initially moving downwardly from its top dead center position, the ports 36 and 37 will not be communicating with each other and the previous low pressure will be retained by the pressure sensing device 35. As the piston 14 moves downwardly and compresses the charge in the crankcase chamber 21, the ports 36 and 37 will come into registry with each other immediately prior to the opening of the port 25 of the transfer passage 23. The ports 36 and 37 communicate with each other for a period of rotation of the crankshaft 16 indicated by the dimension "a". This occurs prior to opening of the scavenge passage 23 and the pressure in the pressure sensing device 35 will rise rapidly so that it is the same as the pressure P(max) in the crankcase chamber 21 immediately prior to the opening of the scavenge passage 23.

As the piston 14 moves downwardly, the ports 36 and 37 will no longer communicate with each other and the maximum pressure will be trapped in the sensing device 35. This pressure may decay slightly due to leakage.

As the piston 14 passes bottom dead center and begins to move upwardly, the ports 36 and 37 will again communicate with each other for the crank angle "a" once the scavenge passage 23 has again closed. At this time, the volume of the chamber 21 will be increasing and a fresh charge will be drawn in from the intake port 19. Hence, the pressure in the sensing device 35 will rapidly decay to that existent in the crankcase chamber 21 at which time the ports 36 and 37 will again move out of communication. Hence, the reduced pressure will be trapped in the sensing device 35 until the piston again moves downwardly so that the ports 36 and 37 communicate with each other.

It should be readily apparent that this construction permits sensing of both maximum and minimum pressures in the chamber 21 prior to any side effects generated by the opening of the transfer or scavenge passages 23. Hence, an accurate pressure signal will be sensed by the device 35 indicative of the air inducted into the crankcase 21 through the intake pipe 18 and intake port 19.

Referring now again to FIG. 1, the arrangement wherein this pressure signal is used so as to control the amount of fuel injected by the nozzle 29 will be described. The sensing device 35, as has been noted, provides a voltage signal indicative of the pressure sensed by it. This sensed pressure is transmitted to an arithmetic unit 38 which temporarily stores the maximum pressure and the minimum pressure and computes a signal indicative of the pressure difference $\Delta$ p which may comprise a voltage V that is, in turn, transmitted to a controller illustrated schematically at 39. The controller 39 receives the voltage signal indicative of the pressure difference from the arithmetic unit 38 and such other external signals as a crankshaft angle signal ($\theta$) transmitted by a suitable sensing device associated with the crankshaft 16, ambient temperature, engine temperature, engine temperature, and other factors to provide a triggering signal to the solenoid valve 36 of the injection nozzle 29. Both the timing and length of this signal will be controlled by the controller 39 so as to provide the desired amount of fuel injected from the nozzle 29 and the timing of this injection. The controller 39 is pre-programmed to provide both the desired timing and duration in response to these sensed conditions including the difference in pressure (Δp)between maximum and minimum in the crankcase chamber 21. Thus, very accurate and effective control for the amount of fuel injected by the nozzle 29 may be enjoyed without the necessity of providing the previously used air flow sensing device in the intake pipe 18.

Figure 4:
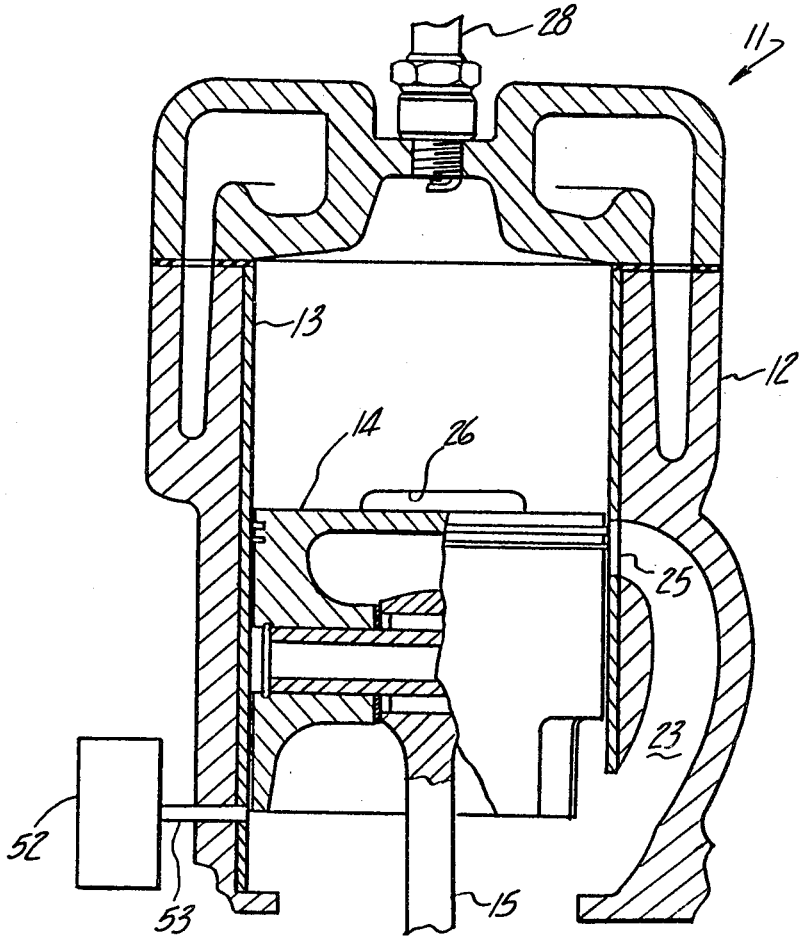
FIG. 4 is an enlarged cross-sectional view, in part similar to FIG. 2, showing another embodiment of the invention.
Figure 5:
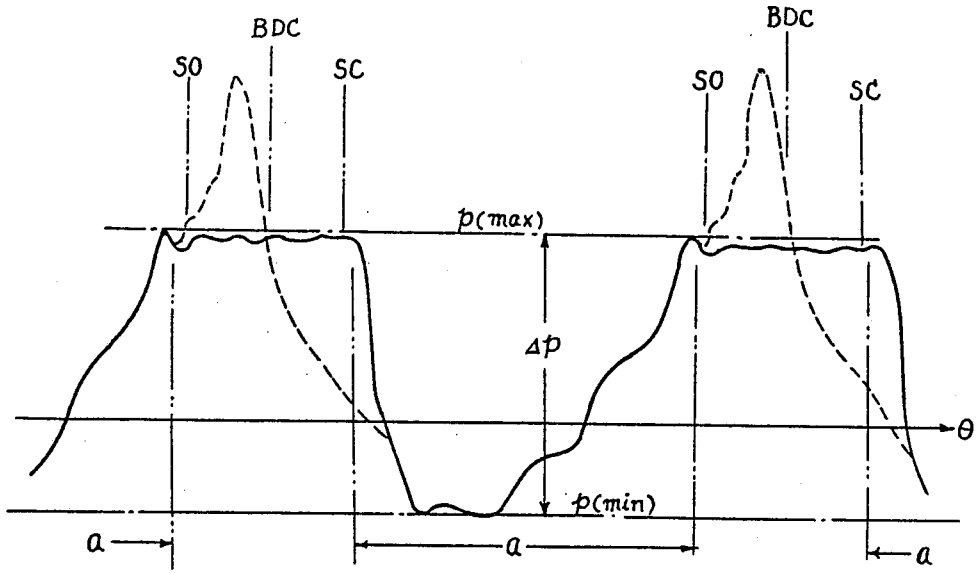
FIG. 5 is a pressure crankshaft angle trace showing the operation of the embodiment of FIG. 4.

FIGS. 4 and 5 show another embodiment of the invention. In the embodiment of FIGS. 1 through 3, the sensing device communicated with the crankcase chamber 21 through a port that extended through the cylinder block and piston. The communicating ports in the cylinder block and piston provided a valve effect that operated in relationship to the crankshaft angle. The embodiment of FIGS. 4 and 5 provides a somewhat similar effect, however, the port through the piston is not required in this embodiment. In this embodiment, the components which are the same as or substantially the same as the previously described embodiment have been identified by the same reference numerals and will not be described again in detail, except insofar as is necessary to understand the construction and operation of this embodiment.

A pressure sensing device 52, which may, as in the previously described embodiment, provide an output voltage indicative of pressure, is provided with a communication passage 53 that extends through the cylinder block 12 and terminates within the cylinder bore 13. The passage 53 is positioned in a location so as to be sequentially opened and closed in response to movement of the piston 14. The location is such that the passage way 53 communicates with the crankcase chamber 21 during the period of time that the piston 14 is moving downwardly and before the transfer port outlet 25 is opened. Once the transfer port 25 is opened, the piston skirt will mask the passage 53 and cut off communication of the crankcase chamber 21 with the pressure sensing device 52 until the piston 14 moves back upwardly to a point when the port opening 25 is again closed.

The pressure trace of this embodiment is shown in FIG. 5 wherein the crankshaft angle ($\theta$) is shown on the abscissa and the pressure (P) is shown on the ordinate. The broken line curve is a trace showing the actual pressure in the crankcase chamber 21 at all conditions. This trace is the same as that of the embodiment of FIG. 3.

The pressure sensed by the sensing device 52 through the passage 53 is shown in the solid line curve in FIG. 5. The period of communication of the passage 53 with the crankcase chamber 21 is indicated by the dimension representative of the crank angle "a".

As the piston 14 moves downwardly toward bottom dead center, the passage 53 is opened and the sensing device 52 will sense the actual crankcase pressure. This pressure rises, as previously noted, until the skirt of the piston 14 closes the passage 53 immediately prior to opening of the scavenge passages 23. Hence, the maximum pressure existent before the scavenge passage 23 is opened will be sensed by the sensing device 52 and transmitted to the arithmetic device 38 as in the previously described embodiment. Once the piston continues its downward movement, the passage 53 will be closed and the peak pressure exerted by the back flow of exhaust gases into the crankcase chamber 21 will be masked from the sensing device 52. After the piston 14 reaches its bottom dead center position and begins to move upwardly and closes the scavenge passage 23, the communication passage 53 will again be opened. Hence, the decrease pressure exerted in the chamber 21 by the expansion of the volume of this chamber will be transmitted to the device 52 so as to permit it to sense the minimum pressure. This minimum pressure is also sensed by the arithmetic device 38 so that it will sense the Δp between maximum and minimum pressures and will otherwise operate as in the previously described embodiment.

Figure 6:
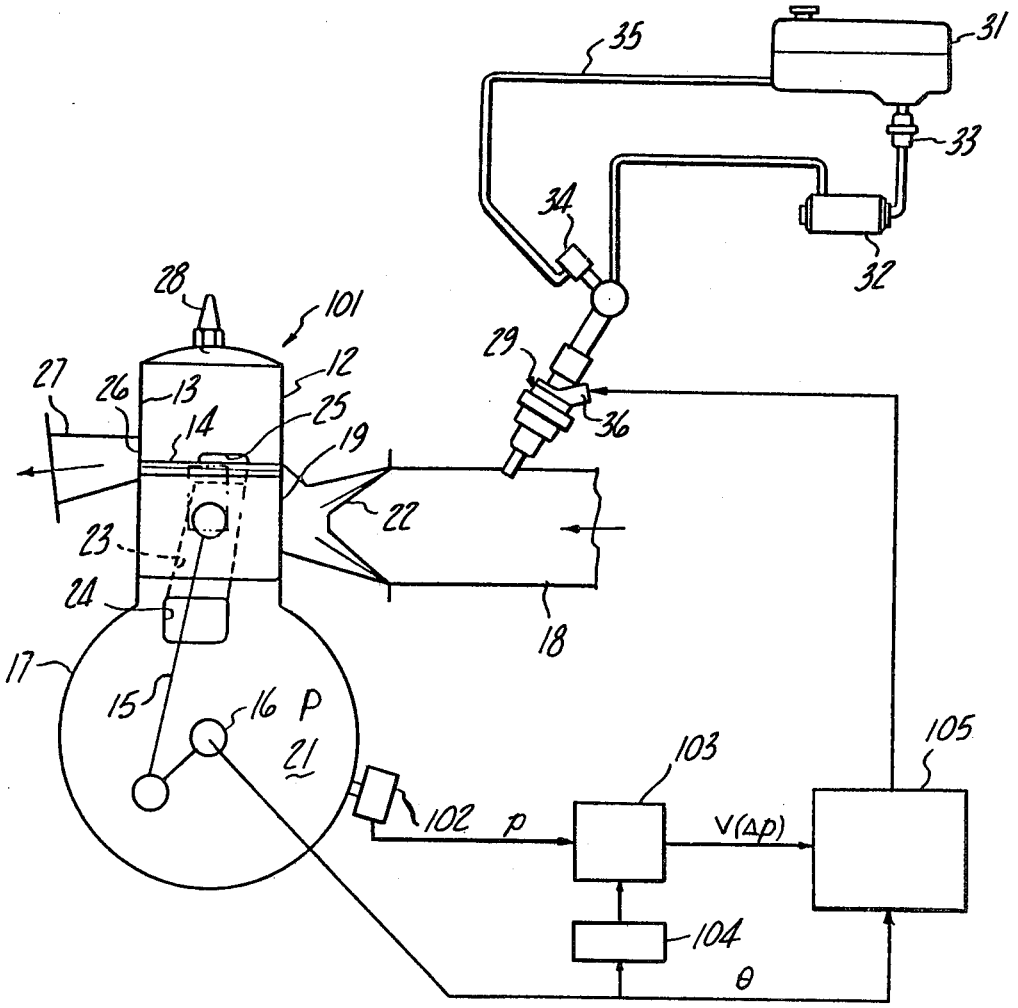
FIG. 6 is a partially schematic view of an internal combustion engine constructed in accordance with a still further embodiment of the invention.

In the two embodiments thus far described, the sensing devices 35 and 52 are protected from sensing maximum pressures exerted by the back flow of exhaust gases through a valving arrangement that is provided by the piston. This valving device is responsive to crankshaft angle due to its operative connection with the piston 14. Other types of devices that are responsive to crankshaft angle may be also incorporated for controlling the sensing device and limiting the sensing of peak pressures due to factors other than the compression of the air charge in the chamber 21. FIG. 6 shows such an embodiment.

In FIG. 6, the reference numeral 101 indicates generally an internal combustion engine constructed in accordance with another embodiment of this invention. With the previously described embodiments, the pressure sensing device is mechanically controlled so as to provide its pressure signals only during a certain predetermined portion of the cycle of operation. FIG. 6 illustrates an embodiment wherein the pressure sensing device is electrically controlled so as to select the pressure sensing only during a predetermined portion of the cycle of engine operation. The mechanical components of the system are the same as the previously disclosed embodiments. Therefore, components which are the same as those which have been previously described and illustrated are identified by the same reference numerals and will be described again only insofar as is necessary to understand the operation of this embodiment.

In this embodiment, a pressure sensing device 102 is provided that communicates with the crankcase chamber 21 so as to provide a continuous voltage signal that is proportional to the instantaneous pressure in the chamber 21. This pressure signal is transmitted to an arithmetic unit 103. In accordance with this embodiment, an interruption signal detector 104 is provided that is responsive the angle of rotation of the crankshaft 16. This device provides a signal to the arithmetic unit 103 which will selectively switch the output of the pressure sensing device 102. That is, the interruption signal detector 104 is operative to disable the signal from the pressure sensing unit 102 except when the crankshaft 16 is at a predetermined angle. This angle is chosen so that it is immediately before opening and immediately after closing of the scavenge port outlet 25. In this way, the arithmetic unit 103 will sense only the peak pressure at a predetermined crankshaft angle before the scavenge port outlet 25 is opened and the minimum pressure at a predetermined crankshaft angle after the scavenge port 25 is closed. These two signals are compared and an output voltage V is provided that is indicative of the pressure difference Δ p. This signal is transmitted to a control unit 105 that sends a pulse to the solenoid valve 36 of sufficient width so as to provide the desired amount of fuel injection. The interruption signal detector 104 also provides a signal to the control unit 105 indicative of crankshaft angle and the control unit 105 is programmed so as to commence the fuel injection at the desired time, as with the previously described embodiments.

It should be readily apparent from the foregoing description that several embodiments of the invention have been described, each of which is effective to sense maximum and minimum pressures at predetermined crankshaft angles so as to avoid the generation of erroneous signals indicative of factors other than the mass of air that has been inducted into the crankcase 21. Although a number of embodiments of the invention have been illustrated and described, various other changes and modifications may be made without departing from the spirit and scope of the invention, as defined by the appended claims.

We claim:

1. In a fuel injection control system for an internal combustion engine comprising a chamber that varies in volume during a cycle of engine operation and fuel injection means for delivering fuel to an air charge, the improvement comprising means for controlling the fuel delivered by said fuel injection means in response to the pressure in said chamber during only a predetermined portion of said cycle.

2. In a fuel injection control system as claimed in claim 1 wherein the controlling means is responsive to the maximum pressure in the chamber during a part of the cycle of operation before the pressure normally reaches its maximum value.

3. In a fuel injection control system as claimed in claim 1 wherein the controlling means is responsive to the pressure in the chamber during a part of the cycle of operation before the pressure normally reaches its minimum value.

4. In a fuel injection control system as claimed in claim 2 wherein the controlling means is responsive to the pressure in the chamber during a part of the cycle of operation before the pressure normally reaches its minimum value.

5. In a fuel injection control system as claimed in claim 4 wherein the controlling means is responsive to the difference between the maximum pressure sensed and the minimum pressure sensed.

6. In a fuel injection control system as claimed in claim 5 wherein the pressures are sensed by a pressure responsive device and further including means for precluding the pressure responsive device from generating a pressure signal except during the predetermined portions of the engine cycle.

7. In a fuel injection control system as claimed in claim 6 wherein the means for precluding the pressure sensing device from providing a pressure signal comprises valving means.

8. In a fuel injection control system as claimed in claim 7 wherein the valving means comprises a port formed in a cylinder of the engine, the engine further including a piston being slidably supported in said cylinder bore and cooperating with said port to function as said valving means.

9. In a fuel injection control system as claimed in claim 7 wherein the means for precluding the pressure sensing from generating a pressure signal comprises electronic means responsive to the portion of the cycle.

10. In a fuel injection control system as claimed in claim 1 wherein the variable volume chamber is a crankcase of the engine.

11. In a fuel injection control system as claimed in claim 10 wherein the controlling means is responsive to the maximum pressure in the crankcase during a part of the cycle of operation before the pressure normally reaches its maximum value.

12. In a fuel injection control system as claimed in claim 10 wherein the controlling means is responsive to the pressure in the crankcase during a part of the cycle of operation before the pressure normally reaches its minimum value.

13. In a fuel injection control system as claimed in claim 11 wherein the controlling means is responsive to the pressure in the crankcase during a part of the cycle of operation before the pressure normally reaches its minimum value.

14. In a fuel injection control system as claimed in claim 13 wherein the controlling means is responsive to the difference between the maximum pressure sensed and the minimum pressure sensed.

15. In a fuel injection control system for an internal combustion engine having a chamber that varies in volume during a cycle of engine operation, an induction system for delivering a charge to said chamber, and a fuel injection means for delivering fuel, the improvement comprising means for controlling the fuel delivered by said fuel injection means in response to a pressure existing during only a predetermined portion of a single cycle of engine operation.

16. In a fuel injection control system as claimed in claim 15 wherein the controlling means is responsive to the maximum pressure in the chamber during a part of the cycle of operation before the pressure normally reaches its maximum value.

17. In a fuel injection control system as claimed in claim 15 wherein the controlling means is responsive to the pressure in the chamber during a part of the cycle of operation before the pressure normally reaches its minimum value.

18. In a fuel injection control system as claimed in claim 16 wherein the controlling means is responsive to the pressure in the chamber during a part of the cycle of operation before the pressure normally reaches its minimum value.

19. In a fuel injection control system as claimed in claim 18 wherein the controlling means is responsive to the difference between the maximum pressure sensed and the minimum pressure sensed.

20. In a fuel injection control system as claimed in claim 19 wherein the pressures are sensed by a pressure responsive device and further including means for precluding the pressure responsive device from generating a pressure signal except during the predetermined portions of the engine cycle.

21. In a fuel injection control system as claimed in claim 20 wherein the means for precluding the pressure sensing device from providing a pressure signal comprises valving means.

22. In a fuel injection control system as claimed in claim 21 wherein the valving means comprises a port formed in a cylinder of the engine, the engine further including a piston being slidably supported in said cylinder bore and cooperating with said port to function as said valving means.

23. In a fuel injection control system as claimed in claim 21 wherein the means for precluding the pressure sensing from generating a pressure signal comprises electronic means responsive to the portion of the cycle.

24. A method of controlling a fuel injection system for an internal combustion engine comprising a chamber that varies in volume during a cycle of operation and in which an intake charge is compressed during engine operation and fuel injection means for delivering fuel to an air charge comprising the steps of measuring the pressure in the chamber only during a portion of the engine cycle and controlling the amount of fuel delivered by the fuel injection means in response to the measured pressure.

25. A method of controlling a fuel injection system for an internal combustion engine having a chamber that varies in volume during a cycle of operation, an induction system for delivering a charge to the chamber, and a fuel injection means for delivering fuel comprising the steps of measuring a pressure that varies during a single cycle of engine operation during only a portion of the cycle and controlling the amount of fuel discharged in response to the measured pressure.

26. A method of controlling a fuel injection system as set forth in claim 25 wherein the pressure is measured as a maximum pressure during a portion of the cycle wherein the pressure does not reach its full maximum pressure and a minimum pressure measured during a portion of the cycle when the pressure does not reach its minimum pressure and the controlling is responsive to the pressure difference.

* * * * *